US005205595A

United States Patent [19]

Svehaug

[11] Patent Number: 5,205,595

[45] Date of Patent: Apr. 27, 1993

[54] LOCK MECHANISM

[76] Inventor: Oswald C. Svehaug, 1010 San Ysidro Blvd., San Ysidro, Calif. 92173

[21] Appl. No.: 902,855

[22] Filed: Jun. 23, 1992

Related U.S. Application Data

[63] Continuation-in-part of Ser. No. 795,540, Nov. 21, 1991, abandoned, and a continuation of Ser. No. 699,432, May 13, 1991, Pat. No. 5,099,581.

[51] Int. Cl.[5] ..... E05C 1/10

[52] U.S. Cl. ..... 292/175; 292/DIG. 38; 292/152

[58] Field of Search ..... 292/175, 152, DIG. 38

[56] References Cited

U.S. PATENT DOCUMENTS

| | | | |
|---|---|---|---|
| 362,805 | 5/1887 | Williams | 292/175 |
| 1,578,598 | 3/1926 | Gidney | 292/175 |
| 2,280,084 | 4/1942 | Segal | 292/152 |
| 3,724,889 | 4/1973 | Dooley | 292/175 |
| 4,909,551 | 3/1990 | Buchanan | 292/175 |
| 4,971,371 | 11/1990 | Gunderson | 292/DIG. 38 |
| 4,971,372 | 11/1990 | Gunderson | 292/DIG. 38 |
| 5,123,681 | 6/1992 | Kos et al. | 292/DIG. 38 |

FOREIGN PATENT DOCUMENTS

| | | | |
|---|---|---|---|
| 2231612 | 11/1990 | United Kingdom | 292/DIG. 38 |

*Primary Examiner*—Eric K. Nicholson
*Attorney, Agent, or Firm*—Henri J. A. Charmasson

[57] ABSTRACT

A simple drawer lock mechanism used in connection with a portable drafting table, combines in a unitary assembly a bolt, an actuating prong passing through an opening in the drawer face, and resilient biasing legs projecting from each side of the bolt. The actuating prong can be squeezed through the opening. The biasing legs can bear against the bottom of the drawer or be anchored to the back of the drawer face.

15 Claims, 3 Drawing Sheets

FIG. 1
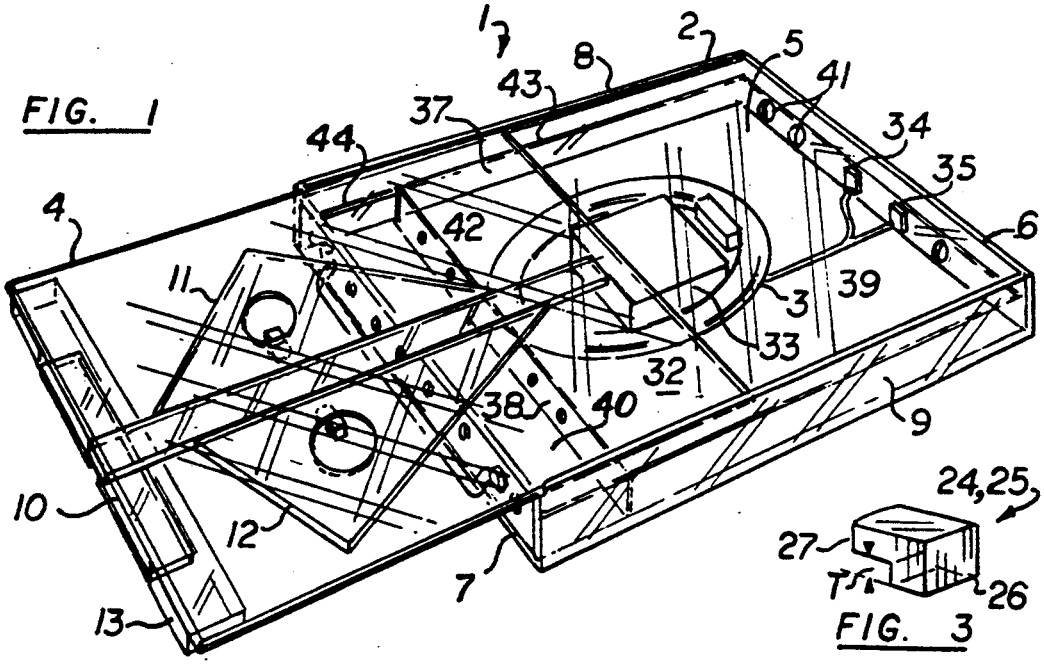
FIG. 3
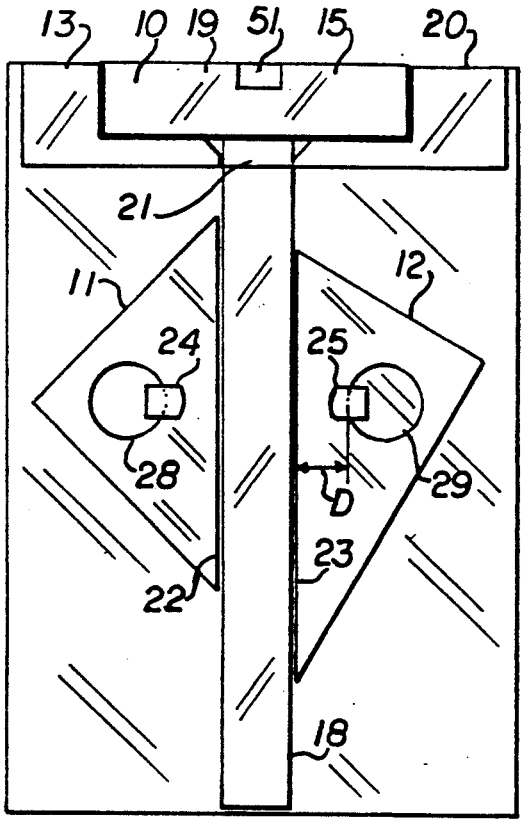
FIG. 2
FIG. 4
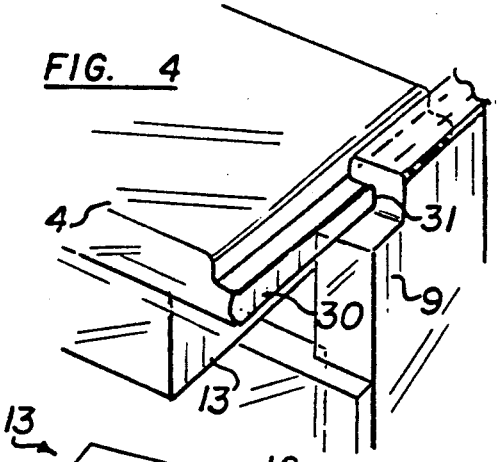
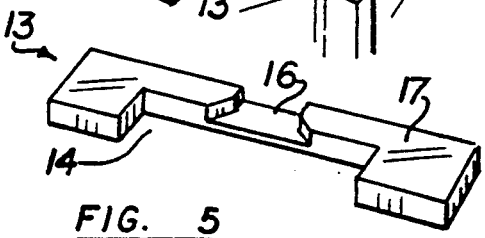
FIG. 5

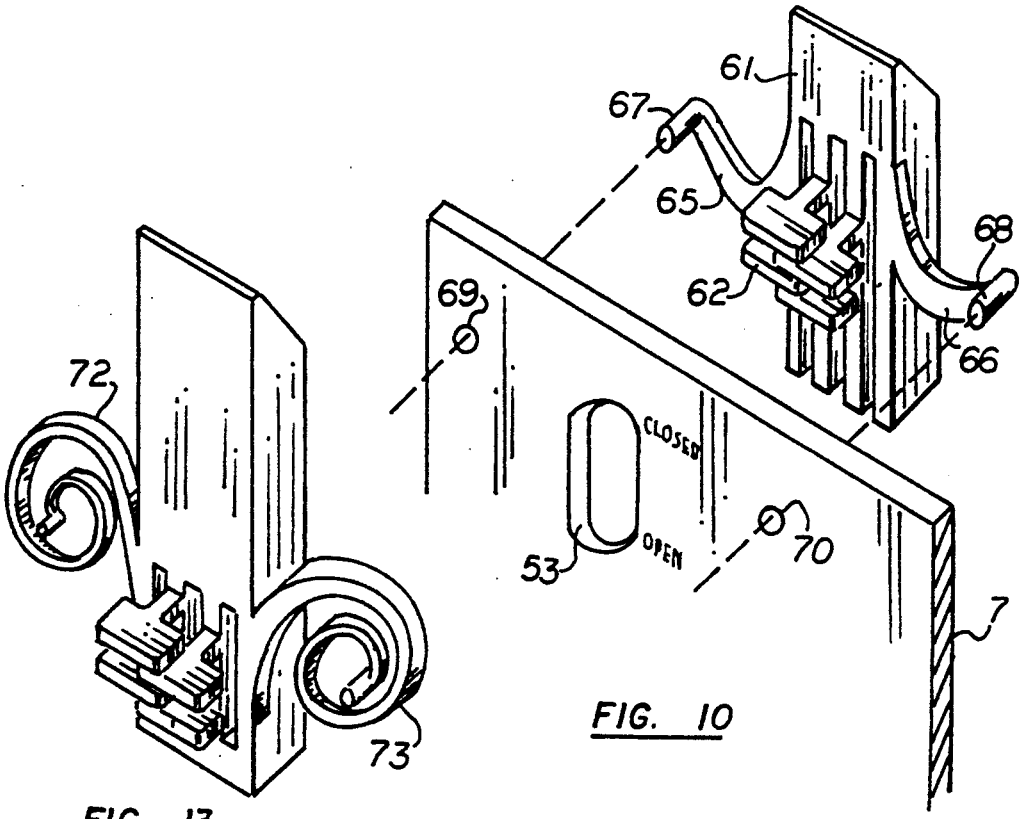
FIG. 10
FIG. 13
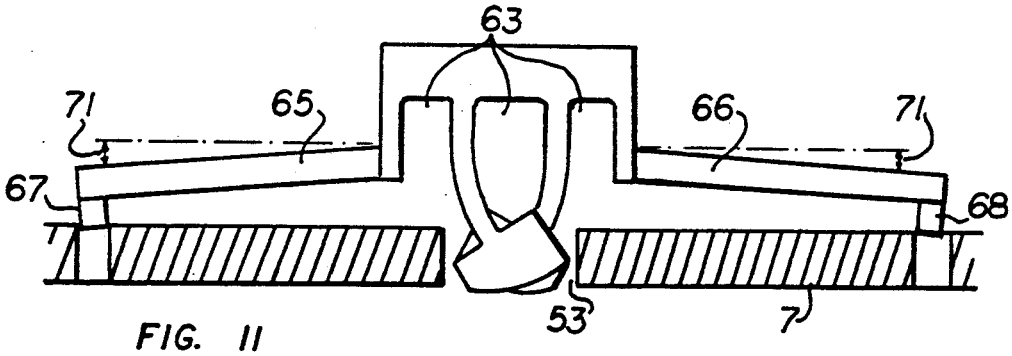
FIG. 11
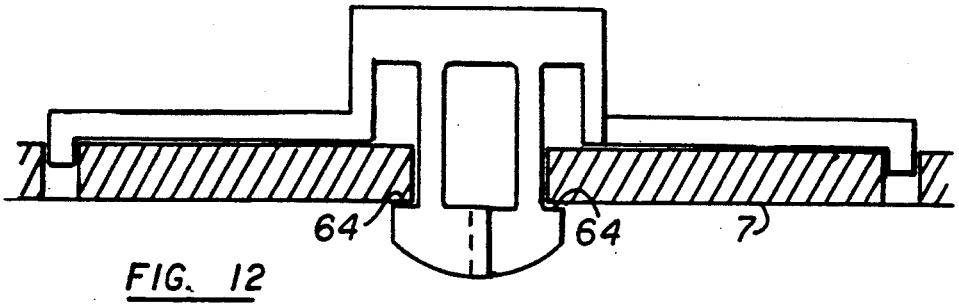
FIG. 12

LOCK MECHANISM

PRIOR APPLICATION

This is a continuation-in-part of co-pending Ser. No. 795,540 filed Nov. 21, 1991, now abandoned and a continuation of Ser. No. 699,432 filed May 13, 1991, now U.S. Pat. No. 5,099,581.

FIELD OF THE INVENTION

This invention relates to drafting tables, and more specifically to lighted drafting tables used for tracing, and to drawer lock mechanisms.

BACKGROUND OF THE INVENTION

The lighted drafting table or tracing table of the prior art are heavy, voluminous, and generally cumbersome structures with a great deal of unused inside space due to the great distance required between the light and the upper transparent or translucent work surface in order to provide even illumination of the latter. When they are used on a desktop or on top of a regular drafting table, their great depth raises the level of the work surface to an uncomfortable level for the draftsman.

There is a need for a more compact, lighted drafting table that can be used as a comfortable drafting station when placed on a desktop.

SUMMARY OF THE INVENTION

The principal and secondary objects of this invention are to provide a shallow, light and versatile lighted drafting table which can also provide storage for drafting implements. These and other objects are achieved by means of a lightweight, portable and shallow tray containing a fluorescent light, with a cover made from a slab of translucent material which slides into slots into the rim of the tray. A set of brackets on the undersurface of the cover are used to hold a T-square and set of triangles made of transparent material. The entire structure is made of translucent polycarbonate material. It is the side of a briefcase and has a convenient carrying handle, as well as a back-hanging slot so that the lighted device may be used as a display for transparencies or even as a light fixture. The cover is secured over the tray by a simple lock mechanism.

BRIEF DESCRIPTION OF THE DRAWING

FIG. 1 is a perspective view of a lighted drafting station according to the invention;

FIG. 2 is a bottom plan view of the cover and the drafting implements stored against it;

FIG. 3 is a perspective view of a triangle holding bracket;

FIG. 4 is a detail view of the cover and side wall interface;

FIG. 5 is a perspective view of the T-square holding bracket;

FIG. 10 is a perspective exploded view of an alternate lock mechanism;

FIG. 11 is a top plan view of the alternate lock mechanism in the process of installation;

FIG. 12 is a top plan view of the lock mechanism in place; and

FIG. 13 is a perspective view of an alternate biasing for the alternate lock mechanism.

DESCRIPTION OF THE PREFERRED EMBODIMENT OF THE INVENTION

Figure 6:
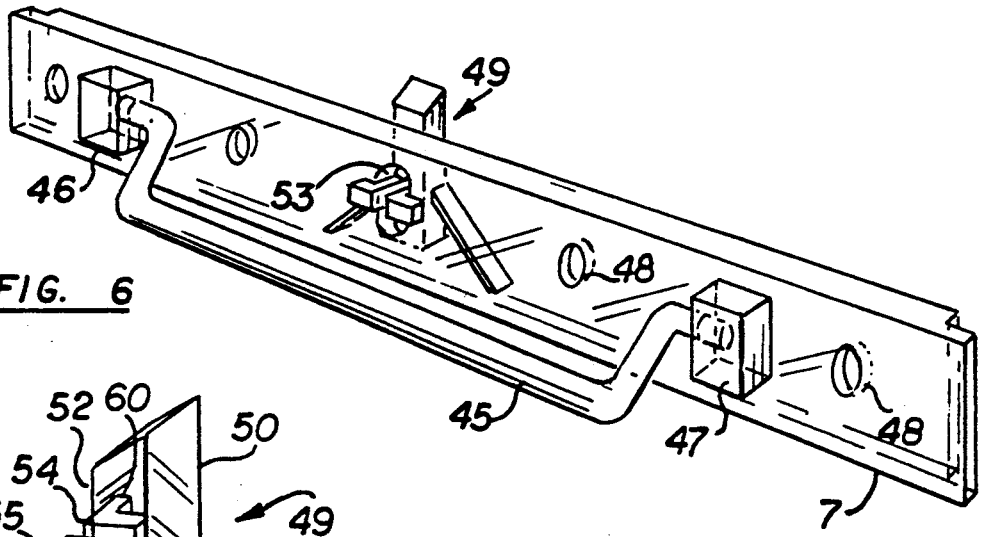
FIG. 6 is a perspective view of the front wall.
Figure 7:
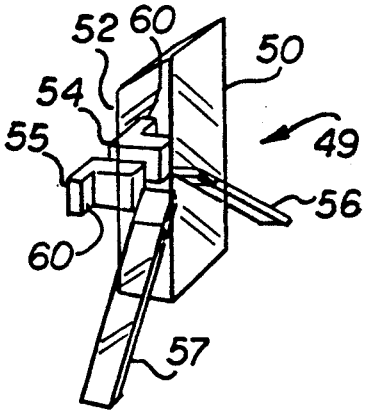
FIG. 7 is a perspective view of the locking bolt.

Referring now to the drawing, there is shown a lighted work station 1 with an illuminated work surface particularly useful for tracing or for viewing transparencies. The work station consists essentially of an enclosure 2 containing a fluorescent circular light 3 and a cover 4 made of a slab of translucent material. The enclosure 2 is a shallow tray having a bottom plate 5 and two pairs of parallel walls 6, 7, 8 and 9. All these structural elements of the enclosure 2 are made of acrylic material. However, while the cover 4 is made of a translucent white hue material, the tray is preferably made of a more opaque material. For sake of clarity in the drawing, the entire enclosure is shown as being made of transparent elements.

Stored against the undersurface of the cover 4 are a T-square 10 and two drafting triangles 11, 12. The T-square and triangles are made from transparent material such as plexiglass. The T-square is held in place by a bracket 13 which has a rectangular recess 14 dimensioned to receive the cross-member 15 of the T-square. A slot 16 in the upper surface 17 of the bracket which is bonded to the underside of the cover 4 is engaged by the leg 18 of the T-square. When the T-square is fully engaged with the outer edge 20 of the cross-piece 15 aligned with the edge 20 of the cover, the slot 16 in the bracket 13 surrounds and holds a neck section 21 of the T-square proximate the intersection of the cross-piece 15 and leg 18.

The triangle 11, 12 are also held against the undersurface of the cover with one side 22, 23 abuting opposite edges of the leg 18 of the T-square. Each triangle is engaged into a L-shaped bracket 24, 25. A first leg 26 of each bracket is bonded to the underside of the cover 4 and the other leg 27 projects toward the center of the cover where the T-square is located. The clearance T between the upper leg and the undersurface of the cover 4 corresponds to the thickness of the triangles. The distance D between the first leg 26 and the edge of the T-square corresponds to the distance between the abuting side 22, 23 of the triangle and a void or cutout 28, 29 in the middle of each triangle. It should be understood that the triangles 11, 12 must first be mounted on their respective brackets 24, 25 before the leg 18 of the T-square is inserted between them.

As more clearly shown in FIG. 4, the cover, has on each side a lip or tongue 30 which slides into a slot 31 in the rim of the tray 2, or more specifically the top edges of the lateral walls 8, 9. A circular fluorescent light 3 is mounted against the bottom center 32 of the tray and surrounds the coil starter and ballast 33. Power is received through an AC connector 34 mounted to the backwall 6 of the tray and a switch 35 similarly mounted. A transparent shield 37 having a right-angle flange 38 protects the fluorescent light 3 starter assembly 33 wiring 39 and internal portions of the connector 34 and switch 35 leaving a storage area 40 along the front panel for drafting tools. Ventilation holes 41 and 42 are cut through the backpanel 6 and the flange 38 of the cover respectively. Like the cover 4, the shield 37 has a lateral lips 43 engaging parallel slot 44 in the lateral walls 8, 9. In order to guarantee the maximum illumination of the translucent cover 4, the internal wall surfaces and bottom of the tray are sprayed with a white or metallic paint.

Figure 8:
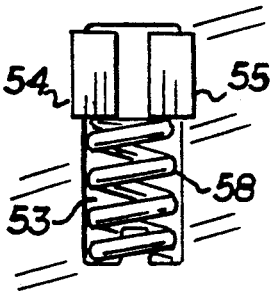
FIG. 8 is a front elevational view of an alternate biasing system for the bolt.
Figure 9:
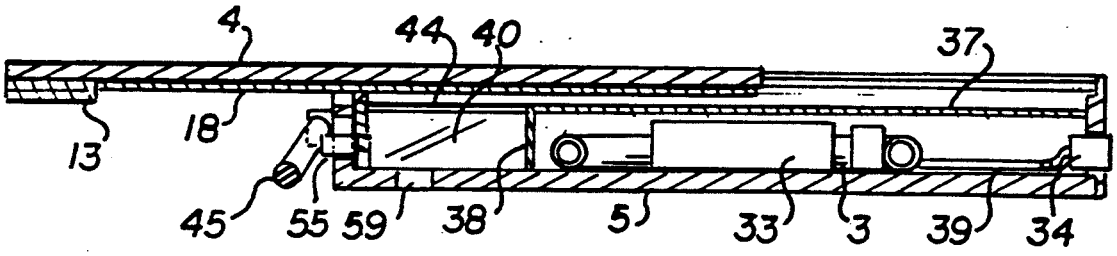
FIG. 9 is a median cross-sectional view of the drafting station.

The front panel 7 has a height slightly smaller than the height of the other walls in order to accommodate the thickness of the T-square holding bracket 13. A carrying handle 45 supported by two mounting blocks 46, 47 bonded to the front surface of the front wall 7 can be used to carry the entire work station like a briefcase. The front wall is pierced with a plurality of aeration holes 48 and includes a lock assembly 49 in its center. The lock assembly 49 consists essentially of a bolt 50 which is shaped and dimensioned to engage a notch 51 in the cross-piece 15 of the T-square. Projecting from the front face 52 of the bolt through a slot 53 in the front wall are two L-shaped prongs 54,55 which are resilient enough to be squeezed one toward the other for insertion through the aperture 53. Each prong has a return nib 60 which is part of the prong and which projects against the front face of the front wall 7 around the rim of the aperture 53 when released thus locking the bolt assembly into place. The bolt 50 is held biased in its uppermost position where it engages the slot 51 in the T-square by two flexible legs 56, 57 extending obliquely from the side of the blocks into contact with the bottom surface of the tray. The bolt can be moved down by pressing on the two L-shaped prongs 54, 55 to free the cover 4. An alternate biasing of the bolt is illustrated in FIG. 8 where the two prongs 54, 55 are biased upwardly by a coil spring 58 mounted within the aperture 53.

A hanging hole 59 is cut through the middle portion of the bottom plate in the storage recess area 40. This hole allows for suspending the drafting station from a nail in a wall for use as a viewing station for transparencies, or even as a light.

An alternate embodiment of the lock assembly is seen in FIGS. **10*k*–12 consisting essentially of a bolt similar to the previous embodiment. Projecting from the front face 61 of the bolt are two pairs of flexible prongs 62. In FIG. 11, each pair is resilient enough to be squeezed one toward the other for insertion through the slot 53 in the front wall 7. The flexibility of the prongs is increased by wells 63 set into the front face of the bolt straddling the intersection of the prongs with the front face. After insertion, the prongs snap back to their original shape FIG. 12. Each prong has a return nib 64 which projects against the front face of the front wall 7** around the rim of the slot, securing the assembly to the front wall.

The bolt is held biased in its uppermost position by two resilient flexible arms 65, 66 each extending from opposite sides of the bolt. The body of each arm may be shaped according to the desired amount of resiliency. Each of these arms has a frontward facing projection 67, 68 which engages a pair of recesses 69, 70 set into the rear face of the front wall. Each of these arms is also canted forward 71 thereby biasing the arms into maintaining close contact with the front wall.

Referring now to FIG. 13, the arms 72, 73 are designed with a body having a spiral configuration to modify their resiliency characteristics thereby influencing the upward bias of the bolt.

While the preferred embodiments of the invention has been described, modifications can be made and other embodiments may be devised without departing from the spirit of the invention and the scope of the appended claims.

What is claimed is:

1. A lock mechanism mountable against a substantially flat section of a cover, drawer, door, or door-jamb, said section having a front face, which comprises:

a bolt mounted against said section;

a pair of resiliently flexible prongs spaced apart and extending orthogonally from a front side of the bolt through an aperture in said section, said prongs sized and dimensioned to pass through said aperture when said prongs are compressed toward each other, each of said flexible prongs having a nib, integral with said prong, projecting against said front face of said section beyond the periphery of said aperture in a rest state, thereby preventing movement of said bolt away from said section; and means for biasing the bolt in one axial direction.

2. The mechanism of claim 1, wherein said means for biasing comprise a pair of resiliently flexible legs extending obliquely from opposite sides of the bolt; and a barrier projecting from said section into contact with said legs.

3. The mechanism of claim 1, wherein said means for biasing comprise a coil spring compressed between said prongs and an end section of said aperture.

4. The mechanism of claim 1, wherein said means for biasing comprise a pair of resiliently flexible arms extending from opposite sides of the bolt.

5. The mechanism of claim 4, wherein each of said flexible arms comprises:

a body;

an end connected to one of said opposite sides of said bolt;

a second end terminating in a projection sized and dimensioned to penetrate a recess set into said section.

6. The mechanism of claim 5, wherein said body comprises a substantially curved structure.

7. The mechanism of claim 5, wherein said body comprises a substantially spiral structure.

8. A lock mechanism mountable against a substantially flat section of a cover, drawer, door, or door-jamb having a front face which comprises:

a bolt mounted against said section;

a plurality of resiliently flexible prongs extending orthogonally from a front side of the bolt through an aperture in said section, each of said flexible prongs having a nib, integral with said prong, projecting against said front face of said section beyond the periphery of said aperture;

means for biasing the bolt in one axial direction; and means for modifying the resiliency of said flexible prongs.

9. The mechanism of claim 8, wherein said means for modifying resiliency comprise one or more wells set into said front side of the bolt adjacent to an intersection between one of said prongs and said front side of bolt.

10. The mechanism of claim 1, wherein said mechanism is formed from one solid piece of material.

11. The mechanism of claim 10, wherein said piece of solid material is polycarbonate.

12. The mechanism of claim 10, wherein said piece of solid material is plastic.

13. A lock mechanism mountable against a substantially flat section of a cover, drawer, door, or door-jamb having a front face which comprises:

a bolt mounted against said section;

a plurality of resiliently flexible prongs extending orthogonally from a front side of the bolt through an aperture in said section, each of said flexible prongs having a nib, integral with said prong, projecting against said front face of said section beyond the periphery of said aperture;

means for biasing the bolt in one axial direction; and means for biasing said mechanism away from said section.

14. The mechanism of claim 13, wherein said means for biasing the mechanism away from said section comprise:

a pair of resiliently flexible arms extending from opposite sides of said bolt;

each of said arms having a forward cant.

15. A lock mechanism mountable against a substantially flat section of a cover, drawer, door, or doorjamb, having a front face and an aperture which comprises:

a bolt having a front side;

means for biasing the bolt in one axial direction;

means for mounting said bolt to said section consisting of:

a pair of resiliently flexible prongs spaced apart and extending orthogonally from said front side of said bolt, sized and dimensioned to insert through said aperture when compressed;

each of said prongs having a nib projecting against said front face of said section beyond the periphery of said aperture when said prongs are uncompressed and inserted.

* * * * *